US005319913A

United States Patent [19]

Stahlecker et al.

[11] Patent Number: 5,319,913

[45] Date of Patent: Jun. 14, 1994

[54] SPINNING MACHINE HAVING DELIVERY ROLLERS AND SUPPORTING DEVICES FOR SLIVERS

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 913,180

[22] Filed: Jul. 14, 1992

Related U.S. Application Data

[63] Continuation-in-part of Ser. No. 894,520, Jun. 4, 1992.

[30] Foreign Application Priority Data

Jul. 30, 1990 [DE] Fed. Rep. of Germany ..... 4118379
Jul. 23, 1991 [DE] Fed. Rep. of Germany ..... 4124314

[51] Int. Cl.[5] ..... D01H 13/04
[52] U.S. Cl. ..... 57/90; 57/352
[58] Field of Search ..... 57/90, 315, 352

[56] References Cited

U.S. PATENT DOCUMENTS 1,961,952 6/1934 Andrew ..... 57/90
3,312,050 4/1967 Noguera ..... 57/90
3,371,388 3/1968 Dillies ..... 57/90 X
3,469,385 9/1969 Tsuzuki ..... 57/90 X
3,564,829 2/1971 Tsuzuki ..... 57/90 X
4,022,007 5/1977 Motobayashi et al. ..... 57/90 X
4,078,369 3/1978 Brandis ..... 57/90 X
4,369,622 1/1983 Teed et al. ..... 57/90 X
4,392,341 7/1983 Grill ..... 57/90

FOREIGN PATENT DOCUMENTS 1015780 1/1966 United Kingdom .

*Primary Examiner*—Joseph J. Hail, III
*Attorney, Agent, or Firm*—Evenson, McKeown, Edwards & Lenahan

[57] ABSTRACT

In the case of a spinning machine comprising spinning stations which are preferably arranged on both sides of the machine, depositing sites for several rows of cans are assigned to each side of the machine which contain the sliver to be spun. Delivery rollers are used for the transport of the slivers between the cans and the spinning stations. Stationary guiding surfaces are arranged between the delivery rollers for supporting the slivers. The guiding surfaces are spaced from a tangent line connecting the delivery rollers. The guiding surfaces are mounted to be selectively adjustably movable in certain preferred embodiments.

19 Claims, 2 Drawing Sheets

FIG. 2
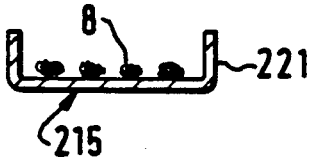
FIG. 3
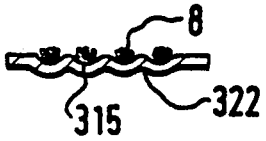
FIG. 4
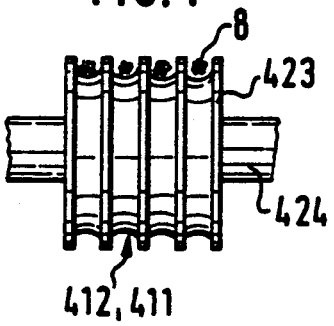
FIG. 5
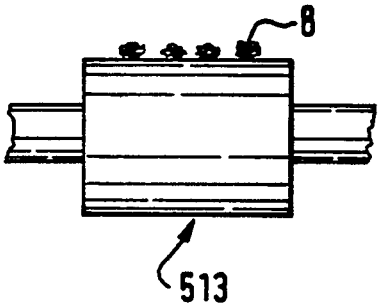
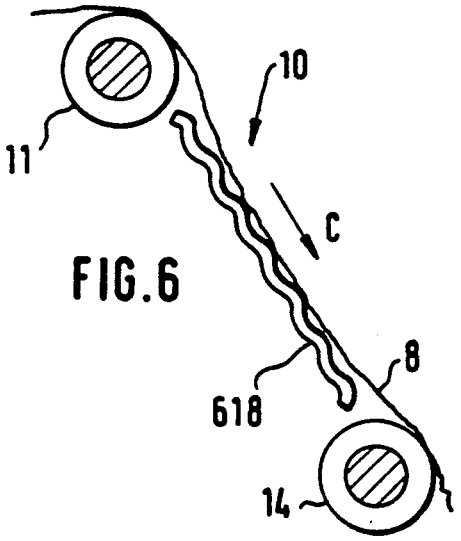
FIG. 6
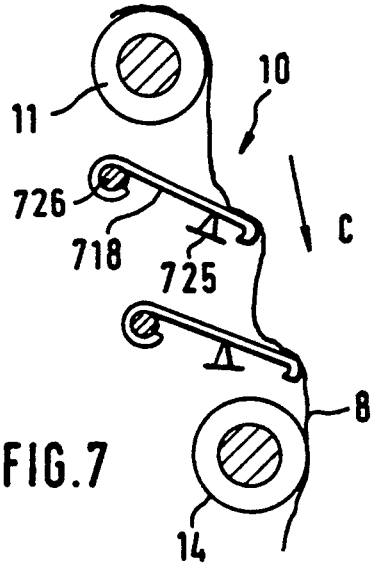
FIG. 7

SPINNING MACHINE HAVING DELIVERY ROLLERS AND SUPPORTING DEVICES FOR SLIVERS

BACKGROUND AND SUMMARY OF THE INVENTION

This application is a continuation-in-part application of application Ser. No. 07/894,520, filed Jun. 4, 1992.

This invention relates to a spinning machine comprising a plurality of spinning stations for the spinning of slivers fed in cans into yarns. Delivery rollers are provided for transporting the slivers from the cans to the spinning stations, and devices are provided for supporting the slivers on their transport path.

It is known from British Patent Document 10 15 780 to feed the fiber material to be spun to a ring spinning machine in the form of slivers. The slivers are taken out of cans from which they are withdrawn by way of rollers arranged above the cans and are then fed to the spinning stations by means of transport devices. The transport devices each consist of pairs of transport belts which receive a sliver between one another and transport it. The pairs of transport belts end directly in front of drafting units assigned to the spinning stations, by means of a pair of delivery rollers.

In the above-noted present application Ser. No. 07/894,520, based on German Patent Application P 41 18 379.7, which is no prior publication, it was suggested to guide the slivers to be spun in a roof-type manner over an operating aisle and to provide a slide between two delivery rollers for the section that is guided obliquely downward to the spinning stations.

It is an object of the invention to simplify a spinning machine of the initially mentioned type with respect to the transport devices.

This object is achieved according to preferred embodiments of the invention in that the devices for the supporting of the slivers contain at least one stationary sliding surface which is arranged between two delivery rollers at a distance from their tangent line.

The invention is based on the recognition that slivers can also be guided along fairly large paths without any transport belts if delivery rollers are provided at certain points and if it is prevented by means of sliding surfaces that the slivers hang down between the delivery rollers in a manner that is too garland-like with too large sagging loop portions. By means of adjusting the distance of the sliding surfaces from the tangent line, it can be adjusted to what extent the driving force of the delivery rollers becomes effective. When the distance from the tangent line is short, the driving force has less effect than when the distance of the sliding surfaces from the tangent line is larger. A compromise must be found with respect to the driving force transmitted by the delivery rollers to the slivers and with respect to preventing an excessive sagging of the slivers between two delivery rollers.

By means of the devices according to the invention, fine slivers of sizes of from Nm 0.3 to 0.8 can also be transported without the risk of faulty drafting during the transport. As a result, it becomes possible in the case of ring spinning machines to do without the machine, specifically the flyer, that is normally connected in front of the ring spinning machines. Furthermore, in the case of such fine slivers, higher yarn qualities than previously can be implemented, in which case, because of the circumstance that no flyer twist exists in the slivers, three-cylinder drafting units may also be used for high drafts of up to 200 times.

In preferred embodiments of the invention, at least three delivery rollers are provided on the transport path of the slivers, between which respective sliding surfaces are arranged. In preferred embodiments, the delivery rollers and/or the sliding surfaces are equipped with lateral guides for the slivers. As a result, it is achieved that the slivers are centered on their transport path.

Advantageously, the sliding surfaces may be provided with longitudinal grooves for the guiding of the slivers. Thus, the slivers are laterally guided virtually along their whole transport path.

As an advantageous development of the invention, it is provided that two sliding surfaces converge in a V-shape in the area of a delivery roller forming the highest point of the transport path. In this manner, for example, an operating aisle situated between the cans and the spinning machine can be bridged along the shortest path while the transport device is no obstacle to the operating personnel.

In a further development of the invention, a run of the transport path is directed downward, in which case the pertaining sliding surface is constructed as a braking surface. The slight braking effect prevents that the slivers can sag as a result of their gravity. The braking effect should exist particularly when the spinning machine is stopped so that, when the transport device is stopped, the slivers do not lead to faulty drafting as a result of their own weight. When the spinning machine is started, however, the friction of the stop must be overcome, and, as a further development of the invention, it is therefore provided that the braking effect of the braking surface can be reduced when the spinning machine is started.

Other objects, advantages and novel features of the present invention will become apparent from the following detailed description of the invention when considered in conjunction with the accompanying drawings.

BRIEF DESCRIPTION OF THE DRAWINGS

FIG. 2 is a cross-sectional view of a sliding surface guiding four slivers travelling next to one another and having lateral guides for the outer slivers, constructed according to a preferred embodiment of the invention;

FIG. 3 is a cross-sectional view of a sliding surface which is provided with four longitudinal grooves for the guiding of four slivers, constructed according to another preferred embodiment of the invention;

FIG. 4 is a view of a delivery roller for four slivers having side rims for the individual slivers, constructed according to another preferred embodiment of the invention;

FIG. 5 is a view of a delivery roller for four slivers situated next to one another without side rims, constructed according to another preferred embodiment of the invention;

FIG. 6 is a view of a sliding surface which is constructed in a wave shape, constructed according to another preferred embodiment of the invention; and FIG. 7 is a view of two step-shaped sliding surfaces arranged between two delivery rollers, constructed according to another preferred embodiment of the invention.

DETAILED DESCRIPTION OF THE DRAWINGS

Figure 1:
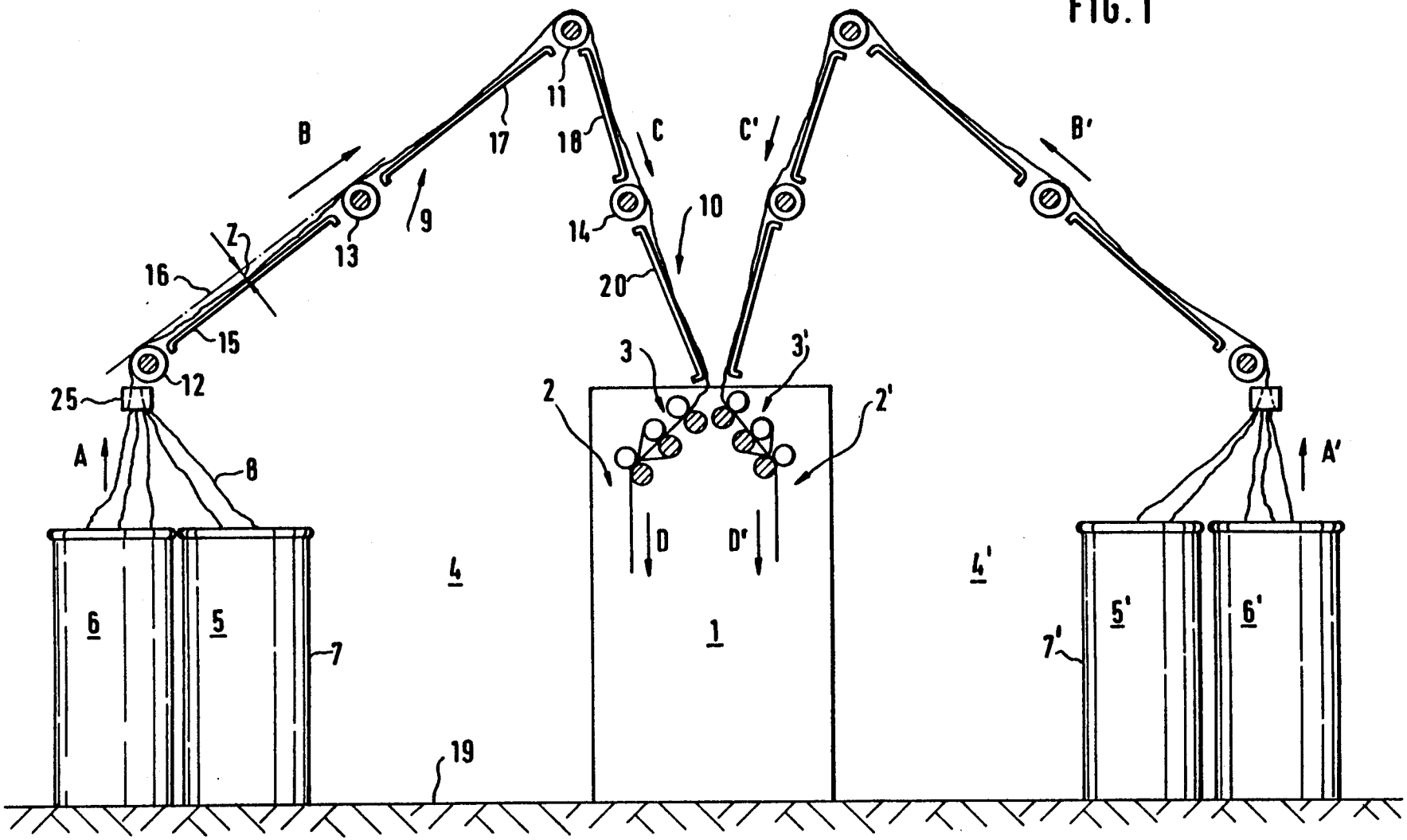
FIG. 1 is a partial cross-sectional view of a machine system constructed according to a preferred embodiment of the invention, comprising a spinning machine to the spinning stations of which one sliver respectively is fed by means of a can, the slivers being transported from the cans to the spinning stations by means of delivery rollers and a respective stationary sliding surface being provided between two delivery rollers respectively for supporting the slivers, constructed according to a preferred embodiment of the invention.

The spinning machine 1 illustrated in FIG. 1 which, for example, is a ring spinning machine, is outlined only schematically. On both sides of the machine, it has a plurality of commonly driven spinning stations 2, 2' arranged next to one another, of which only one drafting unit 3, 3' respectively is shown. The drafting units 3, 3' are constructed as three-cylinder drafting units. In front of the spinning stations 2, 2' one operating aisle 4, 4' respectively for the operating personnel is situated. On the opposite side of the operating aisle 4, 4', several rows 5 and 6 or 5' and 6' of cans 7, 7' are deposited which contain the fiber material which is spun by the spinning stations 2, 2'.

The fiber material is fed to the spinning stations 2, 2' as a sliver 8 produced on a drafting frame. In the case of the representation selected in FIG. 1, it is provided that one sliver 8 respectively is taken from a total of four cans 7 of the two rows 5 and 6. In this case, the cans 7 of a row 5, 6 arranged behind one another in the drawing plane are invisible.

The slivers 8 have a size of from Nm 0.3 to 0.8 so that they can be drafted by the three-cylinder drafting units 3, 3' to the desired yarn size. In this case, the feeding rollers of the drafting units 3, 3' can rotate at such a high rotational speed that a perfect concentricity is ensured.

The relatively fine slivers 8 are withdrawn from the cans 7, 7' in the direction of the arrow A, A', are then guided corresponding to the directions of arrows B and C or B' and C', in a V-shape over the respective operating aisle 4, 4', and finally are drafted in the respective drafting unit 3, 3'. From the drafting units 3, 3', the drafted slivers are fed in the direction of the arrow D or D' to a twist providing element, such as a ring spindle, which is not shown.

The respective transport path has one ascending section 9 and one descending section 10 respectively. Between sections 9 and 10 of the transport path, a highest point exists which is formed by a delivery roller 11. In the ascending section 9, there is a total of two additional delivery rollers 12 and 13 which are arranged at regular but not excessive distances from one another. In this case, the delivery roller 12 is disposed just above rows 5 and 6 of the cans 7.

On the descending section 10, an additional delivery roller 14 is situated which is followed by the feeding roller pair of the drafting unit 3. If necessary, another not shown delivery roller may be arranged directly in front of the drafting unit 3.

So that the tensile stress acting between the delivery rollers 12 and 13, 13 and 11, 11 and 14 as well as the delivery roller 14 and the drafting unit 3 does not become too high, sliding surfaces 15, 17, 18 and 20 are provided for supporting the slivers 8. These sliding surfaces 15, 17, 18 20, in each case, bridge the distance between two delivery rollers 12 and 13, 13 and 11, 11 and 14 as well as 14 and the drafting unit 3. This prevents that the sliver sags excessively between two delivery rollers 12, 13, 11 and 14 because of its own weight. A more extensive sagging may be prevented by means of a higher delivery speed of the delivery rollers 13, 11 and 14, which, however, would increase the tensile stress and may lead to faulty drafts.

The sliding surface 15, which is constructed in the shape of a supporting metal sheet, is situated at a distance z from the tangent 16 indicated by a dash-dotted line, between two adjacent delivery rollers 12 and 13. This applies analogously to the other sliding surfaces 17, 18 and 20. The larger the distance z, the higher the effect of the drive of the delivery rollers 12 and 13. The shorter the distance z, the higher the effect of the sliding friction of the sliding surface 15. By means of tests, a favorable compromise must be found which, among other things, depends on the geometry of the transport path and the fiber material to be spun.

On the delivery roller 11 forming the highest point of the transport path, two sliding metal sheets 17 and 18 are led together in a V-shape. The angle between the sliding surfaces 17 and 18 becomes larger when the cans 7 are not deposited on the floor 19 but, in a manner that is not shown, slightly elevated on a platform.

The sliding metal sheets 18 and 20 on the diagonally descending section 10 of the transport device have a slight braking effect so that the slivers 8 cannot sag. During the normal spinning operation, this braking effect is not so important. It should exist particularly when the spinning machine 1 is stopped so that the now stopped slivers 8, because of their own weight, do not form faulty drafts in section 10.

According to FIG. 2, the supporting metal sheets forming the sliding surfaces 215 are provided with lateral guides 221. As a result, a total of four or even more slivers 8 can be guided which leads to a further simplification of the transport device. As an alternative or a supplement, according to FIG. 3, sliding surfaces 315 may be provided which are provided with longitudinal grooves 322 so that each sliver 8 receives its own path.

The delivery rollers 412 which are assigned directly to the cans 7 as well as the delivery roller 411 forming the upper deflecting guide may be constructed according to FIG. 4, in which case the individual slivers 8 are guided between side rims 423. In this case, the delivery rollers 411, 412 are non-rotatably mounted on a shaft 424 extending through in the longitudinal direction of the machine. As a supplement or an alternative, a sliver guide 25 may be mounted above the cans 7 according to FIG. 1.

The delivery roller 13 situated between the sliding surfaces 15 and 17 is a pure control roller which, according to FIG. 5, may be constructed as a smooth roller 513. On this delivery roller 513, the slivers 8 are laterally unguided because they can be sufficiently guided in front of and behind the delivery roller 513.

According to FIG. 6, the sliding surfaces provided between the delivery rollers 11 and 14 are constructed as so-called corrugated sheets 618 so that the braking effect is stressed. Since, at the start of the spinning machine 1, the friction of the stop must be overcome, it may be advantageous for the corrugated sheet 618 to carry out a small swivel movement away from the sliver 8, only during the start, in a manner that is not shown.

According to FIG. 7, several sliding surfaces 718 may be mounted between the delivery rollers 11 and 14, the angle of slope of which can in each case be adjusted with respect to the horizontal line independently of one another. This may take place, for example, by means of a stop 725 and an adjusting rod 726. As a result, the braking effect can be adjusted in a different manner depending on the used fiber material, and it is also possible to reduce the braking effect for a short time at the start of the spinning machine 1, in that, for example, the sliding surfaces 718 are placed almost perpendicularly.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine comprising:

a plurality of spinning stations for the spinning of slivers fed in cans into yarns, driven delivery rollers for transporting the slivers to the spinning stations from the cans, and supporting devices for supporting the slivers on their transport path, wherein the supporting devices include at least one stationary sliding surface which is arranged between two delivery rollers at a distance from a tangent line connecting the two delivery roller in such a position that the slivers make contact with and slide on the stationary sliding surface.

2. A spinning machine according to claim 1, wherein at least three delivery rollers are provided on the transport path of the slivers between which respective sliding surfaces are arranged.

3. A spinning machine according to claim 1, wherein the at least one of the delivery rollers and the sliding surfaces are provided with lateral guides for the slivers.

4. A spinning machine according to claim 1, wherein two of said sliding surfaces converge in a V-shape in the area of a delivery roller forming a highest point of the transport path.

5. A spinning machine according to claim 1, wherein a section of the transport path is descending, and the pertaining sliding surface is a braking surface.

6. A spinning machine according to claim 5, wherein separately adjustable sliding surfaces are provided between two adjacent delivery rollers at least on a descending section of the transport path.

7. A spinning machine comprising:

a plurality of spinning stations for the spinning of slivers fed in cans into yarns, delivery rollers for transporting the slivers to the spinning stations from the cans, and supporting devices for supporting the slivers on their transport path, wherein the supporting devices include at least one stationary sliding surface which is arranged between two delivery rollers at a distance from a tangent line connecting the two delivery rollers; and further comprising apparatus for adjusting the distance of the sliding surface with respect to the tangent line.

8. A spinning machine according to claim 7, wherein at least three delivery rollers are provided on the transport path of the slivers between which respective sliding surfaces are arranged.

9. A spinning machine according to claim 8, wherein the at least one of the delivery rollers and the sliding surfaces are provided with lateral guides for the slivers.

10. A spinning machine according to claim 9, wherein the sliding surfaces are provided with longitudinal grooves for the guiding of the slivers.

11. A spinning machine according to claim 9, wherein two of said sliding surfaces converge in a V-shape in the area of a delivery roller forming a highest point of the transport path.

12. A spinning machine according to claim 11, wherein a section of the transport path is descending, and the pertaining sliding surface is a braking surface.

13. A spinning machine according to claim 12, wherein apparatus is provided for reducing the braking effect of the braking surface during start up of the spinning machine.

14. A spinning machine according to claim 13, wherein separately adjustable sliding surfaces are provided between two adjacent delivery rollers at least on a descending section of the transport path.

15. A spinning machine according to claim 7, wherein two of said sliding surfaces converge in a V-shape in the area of a delivery roller forming a highest point of the transport path.

16. A spinning machine according to claim 7, wherein a section of the transport path is descending, and the pertaining sliding surface is a braking surface.

17. A spinning machine comprising:

a plurality of spinning stations for the spinning of slivers fed in cans into yarns, delivery rollers for transporting the slivers to the spinning stations from the cans, and supporting devices for supporting the slivers on their transport path, wherein the supporting devices include at least one stationary sliding surface which is arranged between two delivery rollers at a distance from a tangent line connecting the two delivery rollers; and wherein the sliding surfaces are provided with longitudinal grooves for the guiding of the slivers.

18. A spinning machine comprising:

a plurality of spinning stations for the spinning of slivers fed in cans into yarns, delivery rollers for transporting the slivers to the spinning stations from the cans, and supporting devices for supporting the slivers on their transport path, wherein the supporting devices include at least one stationary sliding surface which is arranged between two delivery rollers at a distance from a tangent line connecting the two delivery rollers, wherein a section of the transport path is descending, and the pertaining sliding surface is a braking surface, and wherein apparatus is provided for reducing the braking effect of the braking surface during start up of the spinning machine.

19. A spinning machine according to claim 18, wherein separately adjustable sliding surfaces are provided between two adjacent delivery rollers at least on a descending section of the transport path.

* * * * *